US011281120B2

(12) United States Patent
Tokunaga et al.

(10) Patent No.: US 11,281,120 B2
(45) Date of Patent: Mar. 22, 2022

(54) LIQUID DEVELOPER AND IMAGE-FORMING METHOD

(71) Applicant: CANON KABUSHIKI KAISHA, Tokyo (JP)

(72) Inventors: Yuzo Tokunaga, Chiba (JP); Tomoyo Miyakai, Tokyo (JP); Takashi Hirasa, Moriya (JP); Hayato Ida, Toride (JP); Yasutaka Akashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 3 days.

(21) Appl. No.: 16/885,087

(22) Filed: May 27, 2020

(65) Prior Publication Data

US 2020/0379366 A1 Dec. 3, 2020

(30) Foreign Application Priority Data

May 30, 2019 (JP) ..... JP2019-101820

(51) Int. Cl.

| | |
|---|---|
| ***G03G 9/13*** | (2006.01) |
| ***G03G 9/125*** | (2006.01) |
| ***G03G 9/135*** | (2006.01) |
| ***G03G 9/087*** | (2006.01) |
| ***G03G 9/12*** | (2006.01) |

(52) U.S. Cl.

CPC ..... *G03G 9/125* (2013.01); *G03G 9/08797* (2013.01); *G03G 9/122* (2013.01); *G03G 9/131* (2013.01); *G03G 9/135* (2013.01)

(58) Field of Classification Search

CPC ..... G03G 9/12; G03G 9/125; G03G 9/131; G03G 9/133; G03G 9/135

See application file for complete search history.

(56) References Cited

U.S. PATENT DOCUMENTS

| | | | | |
|---|---|---|---|---|
| 4,170,563 | A * | 10/1979 | Merrill | G03G 9/131 430/115 |
| 4,886,730 | A * | 12/1989 | Oto | G03G 9/12 430/118.1 |
| 5,547,804 | A * | 8/1996 | Nishizawa | C09D 11/106 430/114 |
| 2005/0250029 | A1* | 11/2005 | Moudry | G03G 9/09314 430/108.1 |
| 2013/0034809 | A1* | 2/2013 | Iwata | G03G 9/13 430/114 |

(Continued)

FOREIGN PATENT DOCUMENTS

| | | | |
|---|---|---|---|
| JP | 2003-241439 | A | 8/2003 |
| JP | 2013-160801 | A | 8/2013 |

(Continued)

OTHER PUBLICATIONS

Diamond, Handbook of Imaging Materials, Marcel Dekker, NY, NY 1991.*

*Primary Examiner* — Peter L Vajda

(74) *Attorney, Agent, or Firm* — Canon U.S.A., Inc., IP Division

(57) ABSTRACT

A binder resin of toner particles in a liquid developer contains a resin having a monomer unit derived from at least one polymerizable monomer selected from the group consisting of (meth)acrylates with an alkyl group having 18 to 36 carbon atoms, and the binder resin has an SP value higher by 1.5 $(J/cm^3)^{0.5}$ or more than the SP value of a carrier liquid.

5 Claims, 1 Drawing Sheet

(56) References Cited

U.S. PATENT DOCUMENTS

2020/0379363 A1* 12/2020 Nagaoka ..... G03G 9/08797

FOREIGN PATENT DOCUMENTS

| | | | |
|---|---|---|---|
| JP | 2016-80837 | A | 5/2016 |
| WO | 2006/126566 | A1 | 11/2006 |
| WO | 2007/000974 | A1 | 1/2007 |
| WO | 2007/000975 | A1 | 1/2007 |
| WO | 2007/108485 | A1 | 9/2007 |

* cited by examiner

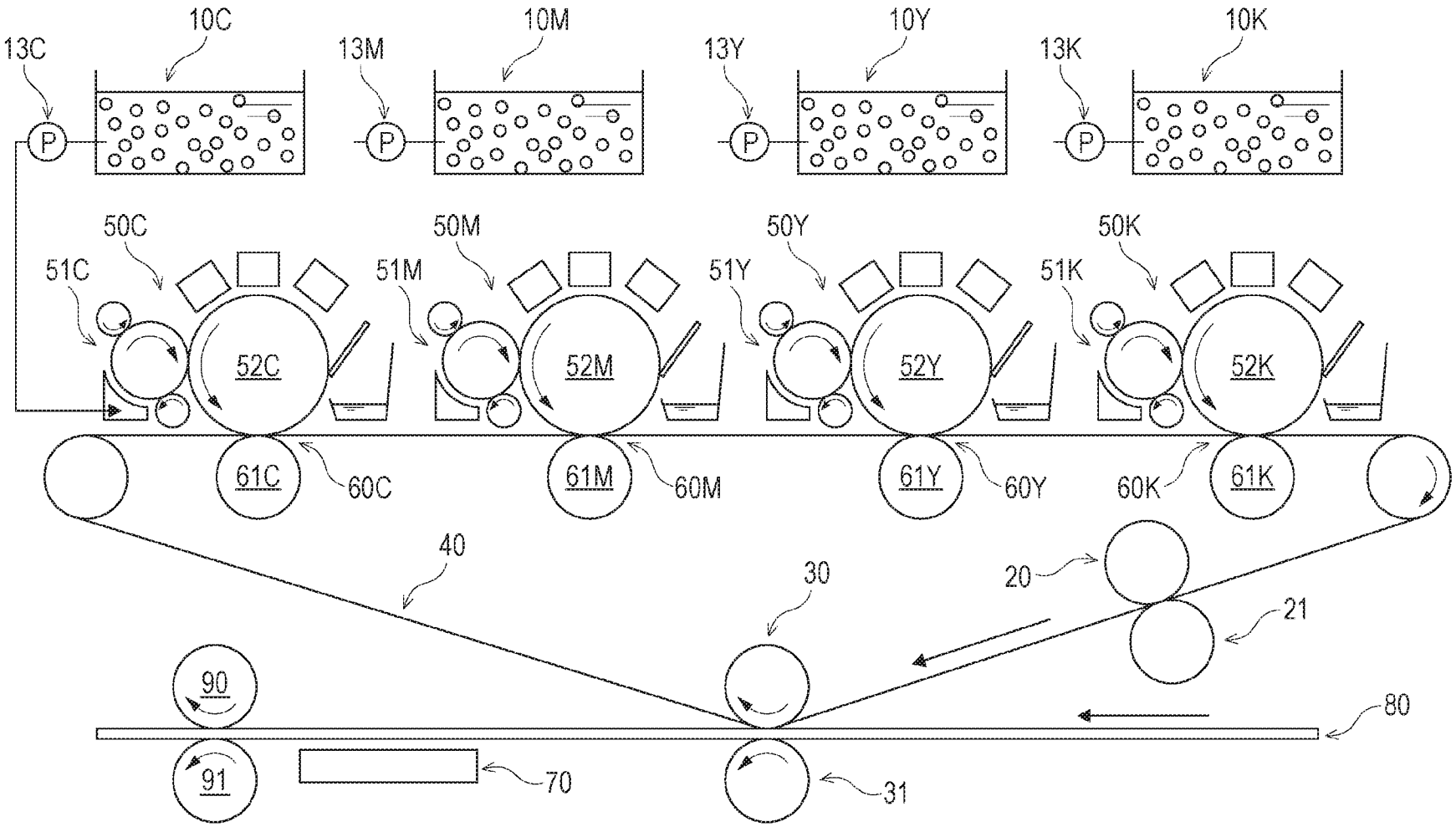
10K
10Y
10M
10C
13K
13Y
13M
13C
P
50K
50Y
50M
50C
51K
51Y
51M
51C
52K
52Y
52M
52C
60K
60Y
60M
60C
61K
61Y
61M
61C
20
21
30
31
40
70
80
90
91

LIQUID DEVELOPER AND IMAGE-FORMING METHOD

BACKGROUND OF THE INVENTION

Field of the Invention

The present disclosure relates to a liquid developer and an image-forming method for use in an electrophotographic image-forming apparatus (electrophotographic apparatus).

Description of the Related Art

An electrophotographic image-forming method includes charging a surface of an image-bearing member (an electrophotographic photoreceptor etc.) (a charging step), forming an electrostatic latent image on the surface of the image-bearing member by exposure to light (an exposure step), developing the electrostatic latent image with a developer (toner) to form a toner image (a developing step), transferring the toner image to a recording medium (a sheet of paper, a plastic film, etc.) (a transferring step), and fixing the transferred toner image to a recording medium (a fixing step), thereby producing an image (a printed material).

Developers are broadly divided into dry developers containing dry toner particles and liquid developers containing a carrier liquid (an electrically insulating liquid) and toner particles dispersed in the carrier liquid. The toner particles contain a binder resin and a colorant (pigment).

In recent years, there has been a growing need for the full colorization, improved image quality, and high-speed printing in electrophotographic image-forming apparatuses (copiers, facsimiles, printers, etc.).

One of developers that can meet these needs is a liquid developer. Because toner particles in a liquid developer are less likely to aggregate particularly during storage, the liquid developer can contain fine toner particles. Thus, a liquid developer can have advantages in easily producing images with high reproducibility of thin lines and tones. With these advantages, electrophotographic image-forming apparatuses that can charge and electrophorese toner particles in a liquid developer for development and transfer have been actively developed. Under such circumstances, there is a demand for a liquid developer with better characteristics.

In a typical method for fixing a liquid developer, the liquid developer is transferred to a recording medium and is then supplied with thermal energy to volatilize and remove a carrier liquid from the liquid developer. The carrier liquid is typically an electrically insulating liquid, such as a hydrocarbon organic solvent or silicone oil.

To reduce fixing energy for energy saving, toner particles can have a lower softening or melting point. Toner particles with a lower softening or melting point, however, may have low storage stability due to fusion or aggregation of the toner particles during the long-term storage of developers.

Japanese Patent Laid-Open No. 2016-80837 discloses toner particles containing a crystalline polyester resin with a particular structure. Japanese Patent Laid-Open No. 2013-160801 discloses the use of an amorphous polyester resin, crystalline polyester resin, or polyurethane thermoplastic elastomer as a toner binder resin.

On the basis of study results of the present inventors, however, a liquid developer containing toner particles described in Japanese Patent Laid-Open No. 2016-80837 had poor storage stability because the elution of resin from the toner particles to a carrier liquid could not be successfully prevented. A liquid developer described in Japanese Patent Laid-Open No. 2013-160801 also had poor storage stability.

SUMMARY OF THE INVENTION

The present disclosure provides a liquid developer with good low-temperature fixability and high storage stability. The present disclosure also provides an image-forming method using the liquid developer.

The present disclosure provides a liquid developer that contains toner particles containing a binder resin and a colorant, and a carrier liquid, wherein the binder resin contains a polymer A having a first monomer unit derived from a first polymerizable monomer, the first polymerizable monomer is at least one polymerizable monomer selected from the group consisting of (meth)acrylates with an alkyl group having 18 to 36 carbon atoms, and the SP value $SP_B$ $(J/cm^3)^{0.5}$ of the binder resin and the SP value $SP_C$ $(J/cm^3)^{0.5}$ of the carrier liquid satisfy the following formula (1).

$$1.5 \leq SP_B - SP_C \quad (1)$$

The present disclosure also provides an image-forming method that includes charging a surface of an image-bearing member, forming an electrostatic latent image on the surface of the image-bearing member by exposure to light, developing the electrostatic latent image with a liquid developer to form a toner image, transferring the toner image to a recording medium, and evaporating a carrier liquid contained in the transferred toner image to fix toner particles contained in the toner image to the recording medium, wherein the liquid developer is the liquid developer described above.

The present disclosure can provide a liquid developer with good low-temperature fixability and high storage stability. The present disclosure can also provide an image-forming method using the liquid developer.

Further features of the present disclosure will become apparent from the following description of exemplary embodiments (with reference to the attached drawings).

BRIEF DESCRIPTION OF THE DRAWINGS

FIGURE is a schematic view of an image-forming apparatus.

DESCRIPTION OF THE EMBODIMENTS

Unless otherwise specified, the numerical range "XX or more and YY or less" or "XX to YY", as used herein, refers to the numerical range including the lower limit (XX) and the upper limit (YY).

The term "(meth)acrylate", as used herein, refers to acrylate and/or methacrylate.

The term "monomer unit", as used herein, refers to one section of a carbon-carbon bond in a main chain of a polymer (polymer chain) formed by the polymerization of a monomer (polymerizable monomer). The monomer (polymerizable monomer) can be a vinyl monomer (vinyl polymerizable monomer). The vinyl monomer (vinyl polymerizable monomer) can be a monomer (polymerizable monomer) represented by the following formula (C).

(C)

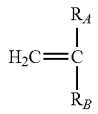

In the formula (C), $R_A$ denotes a hydrogen atom or an alkyl group, and $R_B$ denotes a monovalent group. The alkyl group can be an alkyl group having 1 to 3 carbon atoms or a methyl group.

A monomer unit derived from the monomer (polymerizable monomer) represented by the formula (C) is represented by the following formula (C)'.

(C)'

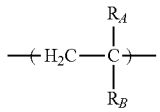

In the formula (C)', $R_A$ denotes a hydrogen atom or an alkyl group, and $R_B$ denotes a monovalent group. The alkyl group can be an alkyl group having 1 to 3 carbon atoms or a methyl group.

A binder resin in toner particles contains a polymer A having a monomer unit derived from at least one polymerizable monomer selected from the group consisting of (meth)acrylates with an alkyl group having 18 to 36 carbon atoms. It is easy to provide the binder resin with crystallinity due to the alkyl group having 18 to 36 carbon atoms. Thus, a liquid developer with high storage stability can be produced. It is also possible to produce toner particles with a good sharp melt property or a liquid developer with good low-temperature fixability.

Less than 18 carbon atoms results in the polymer A with decreased crystallinity, toner particles that easily fuse together, and a liquid developer with decreased storage stability. More than 37 carbon atoms results in a liquid developer with decreased low-temperature fixability due to the polymer A with an increased melting point.

Examples of the (meth)acrylates with an alkyl group having 18 to 36 carbon atoms include (meth)acrylates with a linear alkyl group having 18 to 36 carbon atoms, such as stearyl (meth)acrylate, nonadecyl (meth)acrylate, eicosyl (meth)acrylate, heneicosanyl (meth)acrylate, behenyl (meth)acrylate, lignoceryl (meth)acrylate, ceryl (meth)acrylate, octacosyl (meth)acrylate, myricyl (meth)acrylate, and dotriacontyl (meth)acrylate, and (meth)acrylates with a branched alkyl group having 18 to 36 carbon atoms, such as 2-decyltetradecyl (meth)acrylate.

Among these, the (meth)acrylates with an alkyl group having 18 to 36 carbon atoms can be (meth)acrylates with a linear alkyl group having 18 to 36 carbon atoms in terms of low-temperature fixability. Furthermore, the (meth)acrylates with an alkyl group having 18 to 36 carbon atoms can be (meth)acrylates with a linear alkyl group having 18 to 30 carbon atoms. Furthermore, the (meth)acrylates with an alkyl group having 18 to 36 carbon atoms can be linear stearyl (meth)acrylate and behenyl (meth)acrylate.

A liquid developer containing a binder resin with an SP value $SP_B$ $(J/cm^3)^{0.5}$ and a carrier liquid with an SP value $SP_C$ $(J/cm^3)^{0.5}$ can have improved storage stability when the SP values $SP_B$ and $SP_C$ satisfy the following formula (1).

$$1.5 \leq SP_B - SP_C \quad (1)$$

An $SP_B - SP_C$ of less than 1.5 results in an increased affinity between toner particles and the carrier liquid, and therefore the toner particles easily fuse together during the long-term storage of the liquid developer even containing the binder resin containing the polymer A.

The polymer A can be a polymer of a composition containing a first polymerizable monomer and a second polymerizable monomer different from the first polymerizable monomer.

The polymer A can have a first monomer unit derived from the first polymerizable monomer and a second monomer unit derived from the second polymerizable monomer different from the first polymerizable monomer.

Examples of the second polymerizable monomer include polymerizable monomers with a nitrile group, such as acrylonitrile and methacrylonitrile, and polymerizable monomers with an ester group, such as vinyl esters, for example, vinyl acetate, vinyl propionate, vinyl butyrate, vinyl caproate, vinyl caprylate, vinyl caprate, vinyl laurate, vinyl myristate, vinyl palmitate, vinyl stearate, vinyl pivalate, and vinyl octanoate.

Among these, the second polymerizable monomer can be a monomer (polymerizable monomer) represented by the following formula (A). The monomer (polymerizable monomer) represented by the following formula (A) is a vinyl ester. The monomer (polymerizable monomer) represented by the following formula (A) is an unconjugated monomer and easily retains moderate reactivity with the first polymerizable monomer. Thus, the polymer A can easily have higher crystallinity, and the liquid developer can easily have high storage stability and low-temperature fixability.

(A)

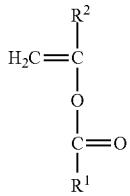

In the formula (A), $R^1$ denotes an alkyl group having 1 to 4 carbon atoms, and $R^2$ denotes a hydrogen atom or a methyl group.

A monomer unit derived from the monomer (polymerizable monomer) represented by the formula (A) is represented by the following formula (A)'.

(A)'

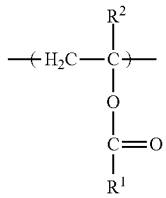

In the formula (A)', R' denotes an alkyl group having 1 to 4 carbon atoms, and $R^2$ denotes a hydrogen atom or a methyl group.

The second monomer unit is a monomer unit derived from the second polymerizable monomer. The second polymerizable monomer may be used alone, or two or more second polymerizable monomers may be used in combination.

In the polymer A in the toner particles, the SP value $SP_{11}$ $(J/cm^3)^{0.5}$ of the first monomer unit and the SP value $SP_{21}$ $(J/cm^3)^{0.5}$ of the second monomer unit can satisfy the following formulae (3) and (4).

$$3.00 \leq SP_{21} - SP_{11} \leq 25.00 \quad (3)$$

$$21.00 \leq SP_{21} \quad (4)$$

Furthermore, the SP value $SP_{12}$ $(J/cm^3)^{0.5}$ of the first polymerizable monomer and the SP value $SP_{22}$ $(J/cm^3)^{0.5}$ of the second polymerizable monomer can satisfy the following formulae (5) and (6).

$$0.60 \leq SP_{22} - SP_{12} \leq 15.00 \quad (5)$$

$$18.30 \leq SP_{22} \quad (6)$$

The unit $(J/m^3)^{0.5}$ of the SP value in the present disclosure can be converted to the unit $(cal/cm^3)^{0.5}$ using the equation: $1\ (cal/cm^3)^{0.5} = 2.045 \times 103\ (J/m^3)^{0.5}$.

Satisfying the formulae (3) and (4) or the formulae (5) and (6) causes a polarity difference between the first monomer unit and the second monomer unit. The polarity difference enables some first monomer units to be continuously bonded (form a block) rather than random bonding between the first monomer unit and the second monomer unit during polymerization (synthesis of the polymer A).

Thus, a moiety composed of the first monomer unit derived from the first polymerizable monomer in the polymer A has high crystallinity, and the liquid developer has high storage stability and low-temperature fixability. Some second monomer units derived from the second polymerizable monomer with a high SP value can also be continuously bonded. This decreases the affinity between the polymer A and the carrier liquid and therefore increases the storage stability of the liquid developer. Furthermore, more types of solvents become available for carrier liquids.

Satisfying the formulae (3) and (4) or the formulae (5) and (6) tends to cause a polarity difference between the first monomer unit and the second monomer unit or between the first polymerizable monomer and the second polymerizable monomer. Thus, in the polymer A, the first monomer unit is less likely to be randomly bonded to the second monomer unit.

Satisfying the formula (4) or (6) results in a decreased affinity between the polymer A and the carrier liquid due to high polarity of the second monomer unit or the second polymerizable monomer.

For a plurality of monomer units that meet the requirements of the first monomer unit in the polymer A, $SP_{11}$ in the formula (3) is the weighted average of the SP values of the monomer units.

For example, when the polymer A includes a monomer unit A and a monomer unit B (monomer unit A≠monomer unit B) that meet the requirements of the first monomer unit, and the monomer unit A with an SP value $SP_{111}$ constitutes A % by mole of the total number of moles of all monomer units that meet the requirements of the first monomer unit, and the monomer unit B with an SP value $SP_{112}$ constitutes (100−A) % by mole of the total number of moles of all monomer units that meet the requirements of the first monomer unit, the SP value ($SP_{11}$) is $$SP_{11} = (SP_{111} \times A + SP_{112} \times (100 \times A))/100$$

This calculation is also applied in the same manner to three or more monomer units that meet the requirements of the first monomer unit. $SP_{12}$ for a plurality of polymerizable monomers that meet the requirements of the first polymerizable monomer is the average value (weight average value) calculated in the same manner from the mole fractions of the polymerizable monomers.

The monomer unit derived from the second polymerizable monomer may be any monomer unit with $SP_{21}$ that satisfies the formula (3) together with $SP_{11}$ calculated by the above method. Likewise, the second polymerizable monomer may be any polymerizable monomer with $SP_{22}$ that satisfies the formula (4) together with $SP_{12}$ calculated by the above method.

For example, when the second polymerizable monomer is composed of two or more polymerizable monomers, $SP_{21}$ is the SP value of a monomer unit derived from each polymerizable monomer, and $SP_{21}-SP_{11}$ is determined for a monomer unit derived from each second polymerizable monomer. Likewise, $SP_{22}$ is the SP value of each polymerizable monomer, and $SP_{22}-SP_{12}$ is determined for each second polymerizable monomer.

The first monomer unit content of the polymer A in the toner particles preferably ranges from 5.0% to 60.0% by mole of the total number of moles of all monomer units in the polymer A. The second monomer unit content of the polymer A preferably ranges from 20.0% to 95.0% by mole of the total number of moles of all monomer units in the polymer A.

The first polymerizable monomer content of a composition to synthesize the polymer A preferably ranges from 5.0% to 60.0% by mole of the total number of moles of all polymerizable monomers in the composition. The second polymerizable monomer content of the composition preferably ranges from 20.0% to 95.0% by mole of the total number of moles of all polymerizable monomers in the composition. At the first monomer unit content and the first polymerizable monomer content in the above ranges, it is possible to provide the polymer A with high crystallinity. Thus, the toner particles can have a better sharp melt property and better low-temperature fixability.

When the polymer A has monomer units derived from two or more (meth)acrylates with an alkyl group having 18 to 36 carbon atoms, the first monomer unit content is the total mole fraction of the monomer units. Likewise, when the composition for the polymer A contains two or more (meth) acrylates with an alkyl group having 18 to 36 carbon atoms, the first polymerizable monomer content is the total mole fraction of the (meth)acrylates.

When the polymer A contains two or more monomer units derived from the second polymerizable monomer satisfying the formula (2), the second monomer unit content is the total mole fraction of the monomer units. Likewise, when the composition for the polymer A contains two or more second polymerizable monomers, the second polymerizable monomer content is the total mole fraction of the second polymerizable monomers.

The polymer A may contain not only the first monomer unit derived from the first polymerizable monomer and the second monomer unit derived from the second polymerizable monomer but also a third monomer unit that, together with the first monomer unit, does not satisfy the formula (3). The third monomer unit is a monomer unit derived from a third polymerizable monomer.

The composition for the polymer A may contain not only the first polymerizable monomer and the second polymerizable monomer but also the third polymerizable monomer that, together with the first polymerizable monomer, does not satisfy the formula (5).

For example, the third monomer unit is a monomer unit that does not satisfy the formula (3) among the polymerizable monomers described above.

For example, the third polymerizable monomer is a polymerizable monomer that does not satisfy the formula (5) among the polymerizable monomers described above.

The polymer A may have a monomer unit derived from a polymerizable monomer, for example, styrene or a derivative thereof, such as styrene or o-methylstyrene, or a (meth) acrylate, such as n-butyl (meth)acrylate, t-butyl (meth)acrylate, or 2-ethylhexyl (meth)acrylate. Those satisfying the formula (3) among these monomer units are the second monomer units.

The composition for the polymer A may contain a polymerizable monomer, for example, styrene or a derivative thereof, such as styrene or o-methylstyrene, or a (meth) acrylate, such as n-butyl (meth)acrylate, t-butyl (meth)acrylate, or 2-ethylhexyl (meth)acrylate. Among these, those satisfying the formula (5) are the second polymerizable monomers.

The tetrahydrofuran (THF) soluble matter of the polymer A preferably has a weight-average molecular weight (Mw) in the range of 10,000 to 200,000, more preferably 20,000 to 150,000, as measured by gel permeation chromatography (GPC).

The polymer A preferably has a melting point in the range of 50° C. to 80° C., more preferably 53° C. to 70° C. The polymer A with a melting point in the above range can provide good low-temperature fixability.

The melting point of the polymer A can be controlled via the type and amount of first polymerizable monomer and the type and amount of second polymerizable monomer to be used to produce the polymer A.

The binder resin in the toner particles may be used in combination with a resin other than the polymer A.

Examples of the resin other than the polymer A include epoxy resins, ester resins, (meth)acrylic resins, styrene-(meth)acrylic resins, alkyd resins, polyethylene resins, ethylene-(meth)acrylic resins, and rosin-modified resins. If necessary, two or more of these may be used in combination.

The toner particles may contain a colorant, such as an organic pigment, an organic dye, an inorganic pigment, a pigment dispersed in an insoluble resin serving as a dispersion medium, or a pigment onto which a resin is grafted.

The following are specific examples of yellow pigments.

C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, or 185; or C.I. Vat Yellow 1, 3, or 20.

The following are examples of red and magenta pigments.

C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, or 269; C.I. Pigment violet 19; or C.I. Vat red 1, 2, 10, 13, 15, 23, 29, or 35.

The following are examples of blue and cyan pigments.

C.I. Pigment Blue 2, 3, 15:2, 15:3, 15:4, 16, or 17; C.I. Vat Blue 6; C.I. Pigment Acid Blue 45, or a copper phthalocyanine pigment having 1 to 5 substituted phthalimidemethyl groups on the phthalocyanine skeleton.

The following are examples of green pigments.

C.I. Pigment Green 7, 8, or 36.

The following are examples of orange pigments.

C.I. Pigment Orange 66 or 51.

The following are examples of black pigments.

Carbon black, titanium black, and aniline black.

The following are examples of white pigments.

Basic lead carbonate, zinc oxide, titanium oxide, and strontium titanate.

A method for dispersing a pigment in toner particles may be a dispersion method suitable for a method for producing toner particles and a liquid developer.

For example, the dispersion method may use a dispersion unit, such as a ball mill, sand mill, attritor, rolling mill, jet mill, homogenizer, paint shaker, kneader, agitator, Henschel mixer, colloid mill, ultrasonic homogenizer, pearl mill, or wet jet mill.

A pigment dispersant may be used to disperse a pigment.

Examples of the pigment dispersant include carboxylates with a hydroxy group, salts of a long-chain polyaminoamide and a high-molecular-weight acid ester, high-molecular-weight polycarboxylic acid salts, high-molecular-weight unsaturated acid esters, high-molecular-weight copolymers, modified polyacrylates, aliphatic polycarboxylic acids, naphthalene sulfonic acid formalin condensates, polyoxyethylene alkyl phosphates, and pigment derivatives. Commercial polymer dispersants, such as Solsperse series manufactured by Lubrizol Corporation, may be used.

A pigment synergist may be used as a pigment dispersing aid.

The pigment dispersant and pigment dispersing aid content of the toner particles preferably ranges from 1 to 50 parts by mass per 100 parts by mass of pigment in the toner particles.

The liquid developer may contain a charge-controlling agent.

The charge-controlling agent may be the following.

Fats and oils, such as linseed oil and soybean oil, alkyd resins, halogen polymers, aromatic polycarboxylic acids, water-soluble dyes with an acidic group, aromatic polyamine oxidation condensates, metallic soaps, such as cobalt naphthenate, nickel naphthenate, iron naphthenate, zinc naphthenate, cobalt octanoate, nickel octanoate, zinc octanoate, cobalt dodecylate, nickel dodecylate, zinc dodecylate, aluminum stearate, and cobalt 2-ethylhexanoate, sulfonic acid metal salts, such as petroleum sulfonic acid metal salts and sulfosuccinate metal salts, phospholipids, such as lecithin and hydrogenated lecithin, alcohol phosphates, such as alcohol phosphonates, salicylic acid metal salts, such as t-butylsalicylic acid metal complexes, polyvinylpyrrolidone resins, polyamide resins, sulfonic acid resins, and hydroxybenzoic acid derivatives.

Alcohol phosphonates, such as dioctyl phosphonate represented by the following formula (B), together with a binder resin, contribute to charge controllability and dispersion stability and improve storage stability.

(B)

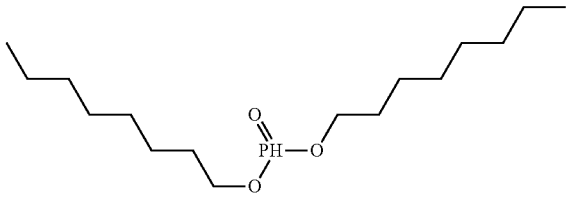

The charge-controlling agent content of the toner particles preferably ranges from 0.01 to 10 parts by mass, more preferably 0.05 to 5 parts by mass, per 100 parts by mass of the toner particles (solid content).

The liquid developer may contain various additive agents to improve recording medium compatibility, storage stability, image storage stability, or another performance, as required.

Examples of the additive agents include filler, antifoaming agents, ultraviolet absorbers, antioxidants, antifading agents, fungicides, and anticorrosives.

A carrier liquid in the liquid developer preferably has a viscosity of 0.5 mPa·s or more and less than 100 mPa·s, more preferably 0.5 mPa·s or more and less than 20 mPa·s, at 25° C. The carrier liquid can be an electrically insulating liquid.

Examples of the carrier liquid include hydrocarbon liquids, such as dimethylbutane, dimethylpentane, octane, isooctane, decane, isodecane, decalin, nonane, dodecane, and isododecane; paraffinic liquids, such as Isopar E, Isopar G, Isopar H, Isopar L, Isopar M, Isopar V (Exxon Mobil Corporation), Shellsol A100, Shellsol A150 (Oxalis Chemicals Ltd. (former Shell Chemicals Japan Ltd.), and Moresco White MT-30P (MORESCO Corporation); silicone oils; and vinyl ethers.

Among these, the carrier liquid can be a paraffinic liquid that is inexpensive, has good electrical insulation properties, has a low SP value, and is liquid at normal temperature.

SP Value Calculation Method

In the present disclosure, the SP values of polymerizable monomers and units derived from the polymerizable monomers are calculated from Fedors's evaporation energies and molar volumes of atoms and atomic groups described in "KOTINGU NO KISO TO KOGAKU" (p. 53, Harasaki Yuji, Converting Technical Institute).

The SP values of binder resins and carrier liquids in the present disclosure are deductively determined by evaluating the solubility of various resins and the dissolving ability of various solvents on the basis of the SP value 14.8 $(J/cm^3)^{0.5}$ of n-hexane.

Method for Producing Liquid Developer

A method for producing a liquid developer according to the present disclosure is a coacervation method or a wet grinding method, for example.

The coacervation method is described in detail, for example, in Japanese Patent Laid-Open No. 2003-241439, International Publication WO 2007/000974, or International Publication WO 2007/000975.

In the coacervation method, first, a colorant, a binder resin, a liquid (solvent) that dissolves the binder resin, and a liquid that does not dissolve the binder resin are mixed to prepare a liquid mixture. The liquid (solvent) that dissolves the binder resin is then removed from the liquid mixture to precipitate the dissolved binder resin. A liquid developer thus produced contains toner particles dispersed in the liquid that does not dissolve the binder resin. A pigment is embedded in the toner particles.

The wet grinding method is described in detail, for example, in International Publication WO 2006/126566 or International Publication WO 2007/108485. In the wet grinding method, first, a pigment and a binder resin are kneaded at a temperature equal to or higher than the melting point of the binder resin and are then dry-ground to prepare a ground product. The ground product is then wet-ground in a liquid serving as a carrier liquid to produce a liquid developer.

Image-Forming Method

A liquid developer according to the present disclosure is suitable for an image-forming method as described below.

An image-forming apparatus is described below with reference to the FIGURE.

First, in a charging step, the surfaces of photosensitive members 52C, 52M, 52Y, and 52K are charged. The photosensitive members are amorphous silicon drums, for example. In a subsequent exposure step, upon light irradiation by image-forming units 50C, 50M, 50Y, and 50K, an electrostatic latent image is formed on the surfaces of the photosensitive members 52C, 52M, 52Y, and 52K. The electrostatic latent image is developed by a liquid developer supplied from liquid developer containers 10C, 10M, 10Y, and 10K to the photosensitive members 52C, 52M, 52Y, and 52K, thereby forming a visible image. The visible image formed by the liquid developer on the surfaces of the photosensitive members 52C, 52M, 52Y, and 52K is primarily transferred to an intermediate transfer belt 40 and is secondarily transferred to a recording medium 80. The recording medium is conveyed over a pre-heating unit 70 to fixing rollers 90 and 91. A carrier liquid is removed from the visible image by drying at a predetermined pressure and/or temperature, and toner particles are fused and fixed to the recording medium.

GPC Measurement of Weight-Average Molecular Weight of Polymer A

The weight-average molecular weight (Mw) of the THF-soluble matter of the polymer A is measured by gel permeation chromatography (GPC), as described below.

First, a toner is dissolved in tetrahydrofuran (THF) at room temperature for 24 hours. The solution is passed through a solvent-resistant membrane filter "Myshori Disk" (manufactured by Tosoh Corporation) with a pore size of 0.2 μm to prepare a sample solution. The sample solution is adjusted such that the concentration of a THF-soluble component is approximately 0.8% by mass. The sample solution is subjected to measurement under the following conditions.

Apparatus: HLC8120GPC (detector: RI) (manufactured by Tosoh Corporation) Column: Shodex KF-801, 802, 803, 804, 805, 806, and 807 (manufactured by Showa Denko K.K.) in series Eluent: tetrahydrofuran (THF)

Flow rate: 1.0 mL/min

Oven temperature: 40.0° C.

Sample injection volume: 0.10 mL

The molecular weight of the sample is calculated from a molecular weight calibration curve, which is prepared using standard polystyrene resins (for example, trade name: TSK standard polystyrene F-850, F-450, F-288, F-128, F-80, F-40, F-20, F-10, F-4, F-2, F-1, A-5000, A-2500, A-1000, and A-500, manufactured by Tosoh Corporation).

Measurement of Melting Point (Tp) of Polymer A

The melting point (Tp) is measured with a differential scanning calorimeter (trade name: Q2000, manufactured by TA Instruments) according to ASTM D3418-82.

The melting points of indium and zinc are used for the temperature correction of a detecting unit, and the heat of fusion of indium is used for calorimetric correction.

More specifically, 3 mg of a sample is weighed and put into an aluminum pan and is subjected to measurement under the following conditions using an empty aluminum pan as a reference.

Heating rate: 10° C./min

Initial temperature: 30° C.

Final temperature: 180° C.

In the measurement, the temperature is increased to 180° C., is held for 10 minutes, is decreased to 30° C. at a cooling rate of 10° C./min, and is increased again. In this second temperature rise, the melt peak temperature (Tp) of the melting point of the polymer A is the temperature of the maximum endothermic peak in a temperature-heat absorption curve in the temperature range of 60° C. to 90° C.

Method for Measuring Volume-Average Particle Diameter of Toner Particles

The volume-average particle diameter of toner particles is measured with a laser diffraction/scattering particle size distribution analyzer (trade name: LA-950, manufactured by Horiba, Ltd.).

The volume-average particle diameter of toner particles preferably ranges from 0.30 to 1.50 μm.

EXEMPLARY EMBODIMENTS

Although the present disclosure is more specifically described in the following exemplary embodiments, the present disclosure is not limited to these exemplary embodiments. Unless otherwise specified, "part" in the following formulations is based on mass.

Production Example of Polymer A1

Solvent: toluene 100.0 parts

Polymerizable monomer composition 100.0 parts

The polymerizable monomer composition was a mixture of the following materials mixed at the following ratio.

Behenyl acrylate (first polymerizable monomer) 79.0 parts (45.9% by mole)

Vinyl acetate (second polymerizable monomer) 21.0 parts (54.1% by mole)

Polymerization initiator: t-butyl peroxypivalate (trade name: Perbutyl PV, manufactured by NOF Corporation) 0.5 parts The materials were put into a reaction vessel equipped with a reflux condenser tube, a stirrer, a thermometer, and a nitrogen inlet in a nitrogen atmosphere. The reaction vessel was heated to 70° C. with stirring at 200 rpm to perform a polymerization reaction for 12 hours, thus preparing a solution of a polymer of the monomer composition dissolved in toluene. The solution was then cooled to 25° C. and was poured into 1000.0 parts of methanol with stirring to precipitate methanol insoluble matter. The methanol insoluble matter was filtered off, was washed with methanol, and was dried under vacuum at 40° C. for 24 hours to prepare a polymer A1. The polymer A1 had a weight-average molecular weight of 63,600 and a melting point of 58.2° C.

An NMR analysis of the polymer A1 showed that a monomer unit derived from behenyl acrylate constituted 45.9% by mole, and a monomer unit derived from vinyl acetate constituted 54.1% by mole. The SP values of the polymerizable monomers and units derived from the polymerizable monomers were calculated by the above method.

Production Examples of Polymers A2 to A13

Polymers A2 to A13 were produced in the same manner as in the production example of the polymer A1 except that the type and amount (mass [parts]) of each polymerizable monomer were changed as shown in Table 1. Tables 1 to 4 show the physical properties of the polymers A1 to A13.

TABLE 1

| | First polymerizable monomer | | | Second polymerizable monomer | | | Third polymerizable monomer | | |
|---|---|---|---|---|---|---|---|---|---|
| Polymer A | Type | Mass [parts] | mol [%] | Type | Mass [parts] | mol [%] | Type | Mass [parts] | mol [%] |
| A1 | BEA | 79.0 | 45.9 | VA | 21.0 | 54.1 | — | — | — |
| A2 | BEA | 75.0 | 34.5 | MN | 25.0 | 65.5 | — | — | — |
| A3 | BEA | 82.0 | 45.9 | AM | 18.0 | 54.1 | — | — | — |
| A4 | BEA | 28.0 | 6.4 | MN | 72.0 | 93.6 | — | — | — |
| A5 | BEA | 87.0 | 57.7 | MN | 8.0 | 30.2 | St | 5.0 | 12.1 |
| A6 | BEA | 62.0 | 28.3 | MN | 9.0 | 23.3 | St | 29.0 | 48.4 |
| A7 | BEA | 90.0 | 61.3 | VA | 10.0 | 38.7 | — | — | — |
| A8 | BEA | 75.0 | 42.0 | MN | 6.0 | 19.1 | St | 19.0 | 38.9 |
| A9 | SA | 25.0 | 6.4 | MN | 75.0 | 93.6 | — | — | — |
| A10 | MYA | 35.0 | 6.8 | MN | 65.0 | 93.2 | — | — | — |
| A11 | BEA | 100.0 | 100.0 | — | — | — | — | — | — |
| A12 | OA | 80.0 | 47.5 | MN | 20.0 | 52.5 | — | — | — |
| A13 | SA | 83.0 | 58.7 | VA | 8.0 | 21.4 | St | 9.0 | 19.9 |

The following are abbreviations in Tables 1 to 3.

BEA: behenyl acrylate

SA: stearyl acrylate

MYA: myricyl acrylate

OA: octadecyl acrylate

MN: methacrylonitrile

AM: acrylamide

VA: vinyl acetate

MA: methyl acrylate

St: styrene

TABLE 2

| | Monomer unit derived from first polymerizable monomer | | Monomer unit derived from second polymerizable monomer | | Monomer unit derived from third polymerizable monomer | |
|---|---|---|---|---|---|---|
| Polymer A | Polymerizable monomer | $SP_{11}$ | Polymerizable monomer | $SP_{21}$ | Polymerizable monomer | $SP_{31}$ |
| A1 | BEA | 18.25 | VA | 21.60 | — | — |
| A2 | BEA | 18.25 | MN | 25.96 | — | — |
| A3 | BEA | 18.25 | AM | 39.25 | — | — |
| A4 | BEA | 18.25 | MN | 25.96 | — | — |
| A5 | BEA | 18.25 | MN | 25.96 | St | 20.11 |
| A6 | BEA | 18.25 | MN | 25.96 | St | 20.11 |
| A7 | BEA | 18.25 | VA | 21.60 | — | — |
| A8 | BEA | 18.25 | MN | 25.96 | St | 20.11 |
| A9 | SA | 18.39 | MN | 25.96 | — | — |
| A10 | MYA | 18.08 | MN | 25.96 | — | — |
| A11 | BEA | 18.25 | — | — | — | — |
| A12 | OA | 18.47 | MN | 25.96 | — | — |
| A13 | SA | 18.39 | VA | 21.60 | — | — |

The polymerizable monomers in Table 2 are polymerizable monomers from which monomer units are derived. $SP_{11}$, $SP_{21}$, and $SP_{31}$ are the SP values of the monomer units.

TABLE 3

| | First polymerizable monomer | | Second polymerizable monomer | | Third polymerizable monomer | |
|---|---|---|---|---|---|---|
| Polymer A | Polymerizable monomer | $SP_{12}$ | Polymerizable monomer | $SP_{22}$ | Polymerizable monomer | $SP_{32}$ |
| A1 | BEA | 17.69 | VA | 18.31 | — | — |
| A2 | BEA | 17.69 | MN | 22.05 | — | — |
| A3 | BEA | 17.69 | AM | 29.12 | — | — |
| A4 | BEA | 17.69 | MN | 22.05 | — | — |
| A5 | BEA | 17.69 | MN | 22.05 | St | 17.94 |
| A6 | BEA | 17.69 | MN | 22.05 | St | 17.94 |
| A7 | BEA | 17.69 | VA | 18.31 | — | — |
| A8 | BEA | 17.69 | MN | 22.05 | St | 17.94 |
| A9 | SA | 17.71 | MN | 22.05 | — | — |
| A10 | MYA | 17.69 | MN | — | — | — |
| A11 | BEA | 17.65 | — | 22.05 | — | — |
| A12 | OA | 17.73 | MN | 22.05 | — | — |
| A13 | SA | 17.71 | VA | 18.31 | — | — |

TABLE 4

| Polymer A | Mw | Tp[° C .] |
|---|---|---|
| A1 | 63600 | 58.2 |
| A2 | 63500 | 60.5 |
| A3 | 61500 | 58.5 |
| A4 | 63500 | 61.0 |
| A5 | 62400 | 61.0 |
| A6 | 64100 | 62.1 |
| A7 | 64200 | 59.1 |
| A8 | 61500 | 59.5 |
| A9 | 64800 | 54.5 |
| A10 | 68600 | 74.5 |
| A11 | 61800 | 50.2 |
| A12 | 62400 | 50.5 |
| A13 | 66500 | 53.9 |

Mw in Table 4 denotes the weight-average molecular weight.

Exemplary Embodiment 1

Production of Liquid Developer 1

Polymer A1 83 parts

Pigment (Pigment Blue 15:3) 17 parts

These materials were well mixed in a Henschel mixer and were melt-kneaded in a co-rotating twin-screw extruder at a roll heating temperature of 100° C. The mixture was cooled and roughly crushed to prepare roughly crushed toner particles.

80 parts of Isopar L (trade name) (manufactured by Exxon Mobil Corporation), 20 parts of the roughly crushed toner particles, and 4.5 parts of a toner particle dispersant (Ajisper PB-817, manufactured by Ajinomoto Fine-Techno Co., Inc.) were then mixed in a sand mill for 72 hours to prepare a toner particle dispersion 1.

The toner particle dispersion 1 was centrifuged, and the supernatant was removed by decantation. The same mass of Isopar L as the supernatant was added to the toner particle dispersion 1, which was then redispersed.

The toner particle dispersion 1 was then mixed with 0.05 parts of an alcohol phosphonate represented by the formula (B) serving as a charge-controlling agent to prepare a liquid developer 1.

The toner particles in the liquid developer 1 had a volume-average particle diameter of 0.72 μm.

Evaluation of Storage Stability

The liquid developer 1 in a 9-mL glass sample bottle was left standing in a thermostat at 40° C. for 90 days. After 90 days, precipitated toner particles were redispersed. Whether the particle size measured by the method for measuring the volume-average particle diameter described above could return to the primary particle size (the volume-average particle diameter after the preparation of the developer±10%) or not was determined according to the following criteria.

The particle size of the liquid developer 1 after left standing for 90 days returned easily to the primary particle size by shaking.

Evaluation Criteria

A: The particle size of precipitated toner returns to the primary particle size by shaking.

B: The particle size of precipitated toner returns to the primary particle size by trituration with a spatula and by shaking.

C: The particle size of precipitated toner returns to the primary particle size by trituration with a spatula and by ultrasonic dispersion.

D: The particle size of part of the precipitated toner does not return to the primary particle size by trituration with a spatula and by ultrasonic dispersion.

E: Precipitated toner cannot be redispersed by trituration.

Evaluation of Fixability

The image-forming apparatus illustrated in the FIGURE was used for evaluation after being adapted for monochromatic development and adapted such that a fixing unit could be independently driven.

A 50 mm×50 mm patch was drawn with the liquid developer 1 on an OK top coat 157 (manufactured by Oji Paper Co., Ltd.), which was the recording medium 80. The bias conditions were set such that the image density was 1.5.

The image density was measured with an X-Rite color reflection densitometer (manufactured by X-Rite Inc., X-rite 500 Series).

The image was fixed at a pre-heating temperature of 60° C., at a fixing rollers 90 and 91 surface temperature of 140° C., at a fixing rollers 90 and 91 pressure of 100 kgf/cm$^2$, and at a fixing speed of 150 mm/s.

The surface of the image was rubbed five times with a lens-cleaning paper (Dusper K-3 manufactured by Ozu Corporation) at a load of 50 g/cm$^2$ and at a speed of 0.2 m/s and was evaluated as described below on the basis of the rate of decrease in image density due to rubbing. The image density was measured with a Macbeth reflection densitometer (manufactured by GretagMacbeth GmbH). The density relative to a printout image on a white background with an original concentration of 0.00 was measured. The rate of decrease in image density due to rubbing was calculated for evaluation.

The fixability of the liquid developer 1 was rated A. No offset adhesion occurred on the upper roller.

Evaluation Criteria

A: less than 2.0%

B: 2.0% or more and less than 5.0%

C: 5.0% or more and less than 9.0%

D: 9.0% or more and less than 15.0%

E: 15.0% or more

Exemplary Embodiment 2

Production of Liquid Developer 2

Polymer A1 81 parts

Pigment (Pigment Blue 15:3) 19 parts Roughly crushed toner particles were produced from these materials in the same manner as in the liquid developer 1.

80 parts of Isopar L (manufactured by Exxon Mobil Corporation), 20 parts of the roughly crushed toner particles, and 4.5 parts of a toner particle dispersant (Ajisper PB-817, manufactured by Ajinomoto Fine-Techno Co., Inc.) were then mixed in a sand mill for 48 hours to prepare a toner particle dispersion 2.

A liquid developer 2 was produced from the toner particle dispersion 2 in the same manner as the liquid developer 1.

The toner particles in the liquid developer 2 had a volume-average particle diameter of 1.12 μm.

Evaluation of Storage Stability

The storage stability was evaluated in the same manner as in Exemplary Embodiment 1 and was rated B because the initial redispersion of toner required trituration with a spatula.

Evaluation of Fixability

The fixability was rated A in the same manner as in Exemplary Embodiment 1. No offset adhesion occurred on the upper roller.

Exemplary Embodiment 3

Production of Liquid Developer 3

Polymer A1 80 parts

Pigment (Pigment Blue 15:3) 20 parts

Roughly crushed toner particles were produced from these materials in the same manner as in the liquid developer 1.

80 parts of Isopar L (trade name) (manufactured by Exxon Mobil Corporation), 20 parts of the roughly crushed toner particles, and 4.5 parts of a toner particle dispersant (Ajisper PB-817, manufactured by Ajinomoto Fine-Techno Co., Inc.) were then mixed in a sand mill for 36 hours to prepare a toner particle dispersion 3.

A liquid developer 3 was produced from the toner particle dispersion 3 in the same manner as the liquid developer 1.

The toner particles in the liquid developer 3 had a volume-average particle diameter of 1.60 μm.

Evaluation of Storage Stability

The storage stability was evaluated in the same manner as in Exemplary Embodiment 1 and was rated C because the initial redispersion of toner required trituration with a spatula and the particle size could be returned to the primary particle size by redispersion with an ultrasonic cleaner.

Evaluation of Fixability

The fixability was rated B in the same manner as in Exemplary Embodiment 1. No offset adhesion occurred on the upper roller.

Exemplary Embodiment 4

Production of Liquid Developer 4

A liquid developer 4 was produced in the same manner as the liquid developer 2 except that Isopar L (trade name) (manufactured by Exxon Mobil Corporation) was replaced with a silicone oil (KF-96L-2cs, manufactured by Shin-Etsu Chemical Co., Ltd.).

The toner particles in the liquid developer 4 had a volume-average particle diameter of 1.12 μm.

Evaluation of Storage Stability

The storage stability was evaluated in the same manner as in Exemplary Embodiment 1 and was rated C because the initial redispersion of toner required trituration with a spatula and the particle size could be returned to the primary particle size by redispersion with an ultrasonic cleaner.

Evaluation of Fixability

The fixability was rated B in the same manner as in Exemplary Embodiment 1. No offset adhesion occurred on the upper roller.

Exemplary Embodiment 5

Production of Liquid Developer 5

Polymer A2 81 parts

Pigment (Pigment Blue 15:3) 19 parts

A liquid developer 5 was produced from these materials in the same manner as the liquid developer 1.

The toner particles in the liquid developer 5 had a volume-average particle diameter of 1.10 μm.

Evaluation of Storage Stability

The storage stability was evaluated in the same manner as in Exemplary Embodiment 1 and was rated B because the initial redispersion of toner required trituration with a spatula.

Evaluation of Fixability

The fixability was rated B in the same manner as in Exemplary Embodiment 1. No offset adhesion occurred on the upper roller.

Exemplary Embodiment 6

Production of Liquid Developer 6

Polymer A3 81 parts

Pigment (Pigment Blue 15:3) 19 parts

A liquid developer 6 was produced from these materials in the same manner as the liquid developer 1.

The toner particles in the liquid developer 6 had a volume-average particle diameter of 1.15 μm.

Evaluation of Storage Stability

The storage stability was evaluated in the same manner as in Exemplary Embodiment 1 and was rated C because the initial redispersion of toner required trituration with a spatula and the particle size could be returned to the primary particle size by redispersion with an ultrasonic cleaner.

Evaluation of Fixability

The fixability was rated C in the same manner as in Exemplary Embodiment 1. No offset adhesion occurred on the upper roller.

Exemplary Embodiment 7

Production of Liquid Developer 7

Polymer A4 81 parts

Pigment (Pigment Blue 15:3) 19 parts

A liquid developer 7 was produced from these materials in the same manner as the liquid developer 1.

The toner particles in the liquid developer 7 had a volume-average particle diameter of 1.05 μm.

Evaluation of Storage Stability

The storage stability was evaluated in the same manner as in Exemplary Embodiment 1 and was rated C because the initial redispersion of toner required trituration with a spatula and the particle size could be returned to the primary particle size by redispersion with an ultrasonic cleaner.

Evaluation of Fixability

The fixability was rated C in the same manner as in Exemplary Embodiment 1. No offset adhesion occurred on the upper roller.

Exemplary Embodiment 8

Production of Liquid Developer 8

Polymer A5 81 parts

Pigment (Pigment Blue 15:3) 19 parts

A liquid developer 8 was produced from these materials in the same manner as the liquid developer 1.

The toner particles in the liquid developer 8 had a volume-average particle diameter of 1.02 μm.

Evaluation of Storage Stability

The storage stability was evaluated in the same manner as in Exemplary Embodiment 1 and was rated C because the initial redispersion of toner required trituration with a spatula and the particle size could be returned to the primary particle size by redispersion with an ultrasonic cleaner.

Evaluation of Fixability

The fixability was rated C in the same manner as in Exemplary Embodiment 1. No offset adhesion occurred on the upper roller.

Exemplary Embodiment 9

Production of Liquid Developer 9

Polymer A6 81 parts

Pigment (Pigment Blue 15:3) 19 parts

A liquid developer 9 was produced from these materials in the same manner as the liquid developer 1.

The toner particles in the liquid developer 9 had a volume-average particle diameter of 1.08 μm.

Evaluation of Storage Stability

The storage stability was evaluated in the same manner as in Exemplary Embodiment 1 and was rated C because the initial redispersion of toner required trituration with a spatula and the particle size could be returned to the primary particle size by redispersion with an ultrasonic cleaner.

Evaluation of Fixability

The fixability was rated C in the same manner as in Exemplary Embodiment 1. No offset adhesion occurred on the upper roller.

Exemplary Embodiment 10

Production of Liquid Developer 10

Polymer A7 81 parts

Pigment (Pigment Blue 15:3) 19 parts

A liquid developer 10 was produced from these materials in the same manner as the liquid developer 1.

The toner particles in the liquid developer 10 had a volume-average particle diameter of 1.30 μm.

Evaluation of Storage Stability

The storage stability was evaluated in the same manner as in Exemplary Embodiment 1. The initial redispersion of toner required trituration with a spatula, and the particle size of some toner particles could not be returned to the primary particle size even by redispersion with an ultrasonic cleaner. The storage stability was sufficient for practical applications but was rated D.

Evaluation of Fixability

The fixability was rated C in the same manner as in Exemplary Embodiment 1. No offset adhesion occurred on the upper roller.

Exemplary Embodiment 11

Production of Liquid Developer 11

Polymer A8 81 parts

Pigment (Pigment Blue 15:3) 19 parts

A liquid developer 11 was produced from these materials in the same manner as the liquid developer 1.

The toner particles in the liquid developer 11 had a volume-average particle diameter of 1.02 μm.

Evaluation of Storage Stability

The storage stability was evaluated in the same manner as in Exemplary Embodiment 1 and was rated C because the initial redispersion of toner required trituration with a spatula and the particle size could be returned to the primary particle size by redispersion with an ultrasonic cleaner.

Evaluation of Fixability

The fixability was rated D in the same manner as in Exemplary Embodiment 1. No offset adhesion occurred on the upper roller.

Exemplary Embodiment 12

Production of Liquid Developer 12

Polymer A9 81 parts

Pigment (Pigment Blue 15:3) 19 parts

A liquid developer 12 was produced from these materials in the same manner as the liquid developer 1.

The toner particles in the liquid developer 12 had a volume-average particle diameter of 1.15 μm.

Evaluation of Storage Stability

The storage stability was evaluated in the same manner as in Exemplary Embodiment 1. The initial redispersion of toner required trituration with a spatula, and the particle size of some toner particles could not be returned to the primary particle size even by redispersion with an ultrasonic cleaner. The storage stability was sufficient for practical applications but was rated D.

Evaluation of Fixability

The fixability was rated B in the same manner as in Exemplary Embodiment 1. No offset adhesion occurred on the upper roller.

Exemplary Embodiment 13

Production of Liquid Developer 13

Polymer A10 81 parts

Pigment (Pigment Blue 15:3) 19 parts

A liquid developer 13 was produced from these materials in the same manner as the liquid developer 1.

The toner particles in the liquid developer 13 had a volume-average particle diameter of 1.20 μm.

Evaluation of Storage Stability

The storage stability was evaluated in the same manner as in Exemplary Embodiment 1 and was rated B because the initial redispersion of toner required trituration with a spatula.

Evaluation of Fixability

The fixability was rated D in the same manner as in Exemplary Embodiment 1. No offset adhesion occurred on the upper roller.

Exemplary Embodiment 14

Production of Liquid Developer 14

A liquid developer 14 was produced in the same manner as the liquid developer 13 except that 0.10 parts of hydrogenated lecithin (trade name: Lecinol S-10, manufactured by Nikko Chemicals Co., Ltd.) was used as a charge-controlling agent.

Evaluation of Storage Stability

The storage stability was evaluated in the same manner as in Exemplary Embodiment 1. The initial redispersion of toner required trituration with a spatula, and the particle size of some toner particles could not be returned to the primary particle size even by redispersion with an ultrasonic cleaner. The storage stability was sufficient for practical applications but was rated D.

Evaluation of Fixability

The fixability was rated D in the same manner as in Exemplary Embodiment 1. No offset adhesion occurred on the upper roller.

Exemplary Embodiment 15

Production of Liquid Developer 15

Polymer A11 81 parts

Pigment (Pigment Blue 15:3) 19 parts

A liquid developer 15 was produced from these materials in the same manner as the liquid developer 1.

The toner particles in the liquid developer 15 had a volume-average particle diameter of 1.20 μm.

Evaluation of Storage Stability

The storage stability was evaluated in the same manner as in Exemplary Embodiment 1. The initial redispersion of toner required trituration with a spatula, and the particle size of some toner particles could not be returned to the primary particle size even by redispersion with an ultrasonic cleaner. The storage stability was sufficient for practical applications but was rated D.

Evaluation of Fixability

The fixability was rated C in the same manner as in Exemplary Embodiment 1. No offset adhesion occurred on the upper roller.

Comparative Example 1

Production of Liquid Developer 16

Polymer A12 81 parts

Pigment (Pigment Blue 15:3) 19 parts

A liquid developer 16 was produced from these materials in the same manner as the liquid developer 1.

The toner particles in the liquid developer 16 had a volume-average particle diameter of 1.25 μm.

Evaluation of Storage Stability

The storage stability was evaluated in the same manner as in Exemplary Embodiment 1 and was rated E because precipitated toner was impossible to triturate and redisperse.

Evaluation of Fixability

The fixability was rated E in the same manner as in Exemplary Embodiment 1. No offset adhesion occurred on the upper roller.

Comparative Example 2

Production of Liquid Developer 17

A liquid developer 17 was produced in the same manner as the liquid developer 2 except that Isopar L (trade name) (manufactured by Exxon Mobil Corporation) was replaced with ethylene glycol diethyl ether (EGDEA).

The toner particles in the liquid developer 17 had a volume-average particle diameter of 1.30 μm.

Evaluation of Storage Stability

The storage stability was evaluated in the same manner as in Exemplary Embodiment 1 and was rated E because precipitated toner was impossible to triturate and redisperse.

Evaluation of Fixability

The fixability was rated B in the same manner as in Exemplary Embodiment 1. No offset adhesion occurred on the upper roller.

Table 5 shows the evaluation results of the developers used in the exemplary embodiments and comparative examples.

TABLE 5

| | Developer | Polymer Ain binder resin | SP of binder resin [(J/cm$^3$)$^{0.5}$] | Carrier liquid | SP of carrier liquid [(J/cm$^3$)$^{0.5}$] | Charge-controlling agent | Volume-average particle diameter of toner particles [μm] | Evaluation of storage stability | Evaluation of fixability |
|---|---|---|---|---|---|---|---|---|---|
| Example 1 | 1 | A1 | 18.03 | Isopar L | 15.60 | Alcohol phosphonate | 0.72 | A | A |
| Example 2 | 2 | A1 | 18.03 | Isopar L | 15.61 | Alcohol phosphonate | 1.12 | B | A |
| Example 3 | 3 | A1 | 18.03 | Isopar L | 15.62 | Alcohol phosphonate | 1.60 | C | B |
| Example 4 | 4 | A1 | 18.03 | Silicone oil | 15.40 | Alcohol phosphonate | 1.12 | C | B |
| Example 5 | 5 | A2 | 20.55 | Isopar L | 15.60 | Alcohol phosphonate | 1.10 | B | B |
| Example 6 | 6 | A3 | 23.87 | Isopar L | 15.60 | Alcohol phosphonate | 1.15 | C | C |
| Example 7 | 7 | A4 | 21.77 | Isopar L | 15.60 | Alcohol phosphonate | 1.05 | C | D |
| Example 8 | 8 | A5 | 19.03 | Isopar L | 15.60 | Alcohol phosphonate | 1.02 | C | C |
| Example 9 | 9 | A6 | 18.81 | Isopar L | 15.60 | Alcohol phosphonate | 1.08 | C | C |
| Example 10 | 10 | A7 | 17.93 | Isopar L | 15.60 | Alcohol phosphonate | 1.30 | D | C |
| Example 11 | 11 | A8 | 18.60 | Isopar L | 15.60 | Alcohol phosphonate | 1.02 | C | D |
| Example 12 | 12 | A9 | 21.77 | Isopar L | 15.60 | Alcohol phosphonate | 1.15 | D | B |
| Example 13 | 13 | A10 | 21.75 | Isopar L | 15.60 | Alcohol phosphonate | 1.20 | B | D |
| Example 14 | 14 | A10 | 21.75 | Isopar L | 15.60 | Hydrogenated lecithin | 1.20 | D | D |
| Example 15 | 15 | A11 | 17.69 | Isopar L | 15.60 | Alcohol phosphonate | 1.20 | D | C |
| Comparative example 1 | 16 | A12 | 20.00 | Isopar L | 15.60 | Alcohol phosphonate | 1.25 | E | E |
| Comparative example 2 | 17 | A1 | 18.03 | EGDEA | 16.60 | Alcohol phosphonate | 1.30 | E | B |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-101820, filed May 30, 2019, which is hereby incorporated by reference herein in its entirety.

What is claimed is:

1. A liquid developer comprising:

toner particles containing a binder resin and a colorant; and a carrier liquid, wherein;

the binder resin contains a polymer A having a first monomer unit derived from behenyl acrylate, and an SP value $SP_B$ (J/cm$^3$)$^{0.5}$ of the binder resin and an SP value $SP_C$ (J/cm$^3$)$^{0.5}$ of the carrier liquid satisfy the following formula (1)

$$1.5 \leq SP_B - SP_C \quad (1), \text{ and}$$

wherein, the polymer A is a polymer of a composition containing:

the behenyl acrylate as a first polymerizable monomer; and vinyl acetate as a second polymerizable monomer, a content of the behenyl acrylate in the composition ranges from 5.0% to 60.0% by mole of a total number of moles of all polymerizable monomers in the composition, and a content of the vinyl acetate in the composition ranges from 20.0% to 95.0% by mole of the total number of moles of all polymerizable monomers in the composition.

2. The liquid developer according to claim 1, wherein the carrier liquid is a paraffinic liquid.

3. The liquid developer according to claim 1, wherein the toner particles have a volume-average particle diameter in the range of 0.30 to 1.50 μm.

4. The liquid developer according to claim 1, further comprising an alcohol phosphonate.

5. An image-forming method comprising:

charging a surface of an image-bearing member;

forming an electrostatic latent image on the surface of the image-bearing member by exposure to light;

developing the electrostatic latent image with a liquid developer to form a toner image;

transferring the toner image to a recording medium; and evaporating a carrier liquid contained in the transferred toner image to fix toner particles contained in the toner image to the recording medium;

wherein, the liquid developer comprises:

toner particles containing a binder resin and a colorant; and a carrier liquid, wherein, the binder resin contains a polymer A having a first monomer unit derived from behenyl acrylate, and an SP value $SP_B$ (J/cm$^3$)$^{0.5}$ of the binder resin and an SP value $SP_C$ (J/cm$^3$)$^{0.5}$ of the carrier liquid satisfy the following formula (1)

$$1.5 \leq SP_B - SP_C \quad (1), \text{ and}$$

wherein, the polymer A is a polymer of a composition containing:

the behenyl acrylate as a first polymerizable monomer; and vinyl acetate as a second polymerizable monomer, a content of the behenyl acrylate in the composition ranges from 5.0% to 60.0% by mole of a total number of moles of all polymerizable monomers in the composition, and a content of the vinyl acetate in the composition ranges from 20.0% to 95.0% by mole of the total number of moles of all polymerizable monomers in the composition.

* * * * *